United States Patent [19]

Fry

[11] 3,953,904

[45] May 4, 1976

[54] DESIGN AND CONSTRUCTION OF HULLS

[75] Inventor: Jeremy Joseph Fry, Bath, England

[73] Assignee: Rotork Marine Limited, Bath, England

[22] Filed: Sept. 23, 1974

[21] Appl. No.: 508,572

Related U.S. Application Data

[63] Continuation of Ser. No. 342,502, March 19, 1973, abandoned.

[30] Foreign Application Priority Data

Mar. 29, 1972 United Kingdom ..... 14821/72

[52] U.S. Cl. ..... 9/1 R; 114/.5 F; 114/66.5 F

[51] Int. Cl.[2] ..... B63B 7/06

[58] Field of Search ..... 114/.5 BD, .5 F, 66.5 F, 114/61; 115/1 B; 9/1 R, 2 A, 6, 11 A, 11 R; 280/18

[56] References Cited

UNITED STATES PATENTS

| | | | |
|---|---|---|---|
| 2,742,012 | 4/1956 | Bridges | 114/.5 F |
| 2,993,459 | 7/1961 | Storey | 114/.5 F |
| 3,432,182 | 3/1969 | Solipasso | 280/18 |
| 3,605,148 | 9/1971 | Tailer | 9/1 R |
| 3,614,937 | 10/1971 | Schulman | 114/66.5 F |
| 3,800,721 | 4/1974 | Taylor | 114/.5 F |

*Primary Examiner*—Trygve M. Blix
*Assistant Examiner*—Stuart M. Goldstein
*Attorney, Agent, or Firm*—Stevens, Davis, Miller & Mosher

[57] ABSTRACT

This invention relates to a hull construction more particularly for marine craft provided with power propulsion. The hull includes at least one layer of tube-like members which extend longitudinally of the hull and are interconnected to form an integral structure. Winches are positioned on the hull and are operable to impart a predetermined upward bending or shaping to one or both end portions of the tube-like members which are preferably formed of a plastics material such as polyethylene.

14 Claims, 19 Drawing Figures

DESIGN AND CONSTRUCTION OF HULLS

This is a continuation, of application Ser. No. 342,502 filed 3/19/73, now abandoned.

This invention relates to the design and construction of hulls, more particularly, but not exclusively, for marine craft provided with some form of power propulsion. In its broadest application the invention is applicable to hulls which may be used either as a marine craft, or as a floating pontoon or bridge member.

According to the invention the hull basically comprises at least one layer of tube-like members which extend longitudinally of the hull and are interconnected to form an integral structure.

In a preferred embodiment of the invention the tube-like members are interconnected or otherwise held together so that the adjacent tubes of the layer abut each other. The tube-like members are preferably located in the same horizontal plane so as to provide a flat hull construction and the structure is provided also with suitable means for imparting a predetermined upward bending or shaping of the front end portions of the tube-like members. The upward bending of the tube-like members to provide a bow structure of predetermined shape may be obtained by means of superstructure mounted on the hull intermediate the ends of the tube-like members, the superstructure providing a support for a pair of spaced tensioning members located one at each side of the hull structure. Each tensioning means is connected at one end of the front end of the corresponding outermost tube-like member of the hull and at its other end to a tension applying means, such as a winch. The winches may be mounted on or connected with a rigid member such a cross beam provided adjacent the stern of the hull. The front ends of the tube-like members are also interconnected by a suitable cross member which, in the preferred embodiment, is a linkage forming a chain-like structure so that when tension is applied by means of the winches to the outermost tube-like members the front ends of the layer of tube-like members will bend upwardly differing amounts to provide a bow structure which follows the shape of a catenary and which probably conforms more closely to that of a parabolic catenary.

In order to use the hull as a pontoon or bridge member tension is relieved from the outermost tube-like members so that they can resume their normal flat shape in the horizontal plane of the hull. The hulls may be then interconnected by abutment of corresponding tube-like members of adjacent hulls and to facilitate this interconnection of hull structures the tube-like members may be suitably shaped fit within each other.

In order that the invention may be clearly understood embodiments will now be described by way of example with reference to the accompanying drawings, in which.

Referring now to FIGS. 1 to 4 of the drawings there is shown a hull structure 10 in accordance with the invention and which comprises basically a plurality of tubular members 11 which are interconnected or otherwise held together so as to form an integral assembly.

In the construction of the hull 10 the tubes 11 are positioned longitudinally and are made of a resilient material which will allow bending of the tubes as will be hereinafter explained. Suitable plastics materials which may be used are polyethylene, polypropylene, and A.B.S. (acrylonitrile-butadiene-styrene resins) as these plastics materials provide tubes for the structure which are substantially rigid, particularly in cross-section, but which are slightly resilient or flexible so as to be capable of bending along their length.

In practical embodiments of the invention the tubes 11 forming the hull 10 have a diameter of about 12 to 48 inches and a thickness of about ¼ of an inch to 1¼ inches. The tubes are of a length providing the desired hull structure and tubes 11 having a length of 25 to 100 feet have been used.

Figure 1:
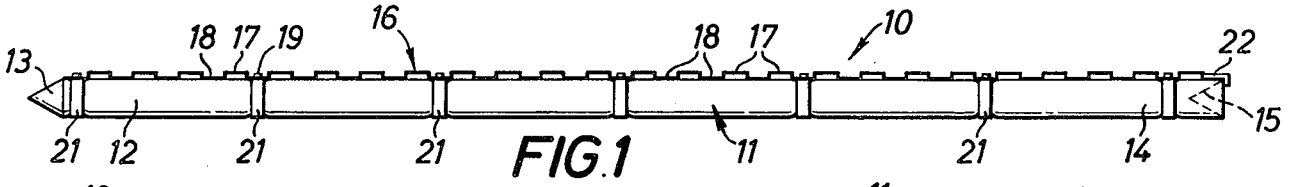
FIG. 1 is a side elevation of a hull structure in accordance with the invention.
Figure 2:
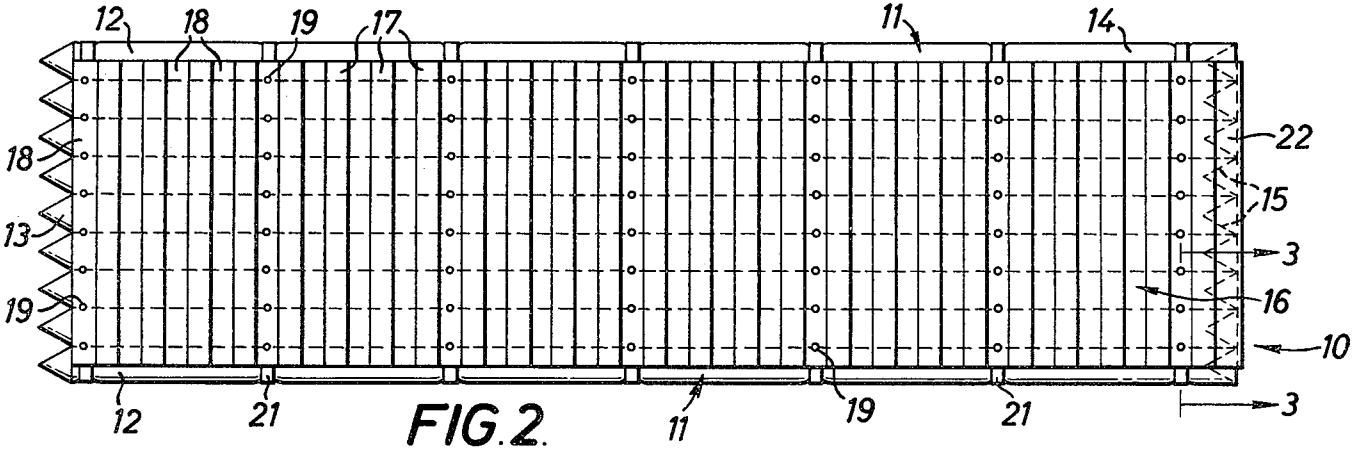
FIG. 2 is a plan view of the hull structure of FIG. 1.
Figure 3:
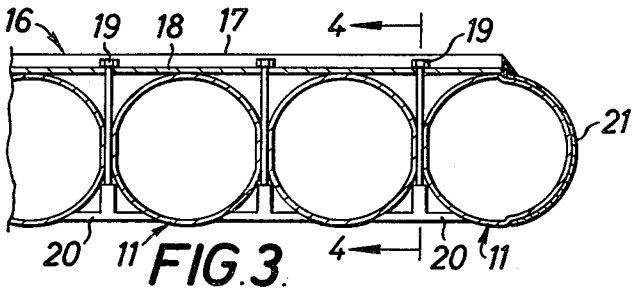
FIG. 3 is a section on the line 3—3 of FIG. 2 on a greatly enlarged scale.

In the hull structure 10 shown in FIGS. 1 to 4 of the drawings identical tubes 11 are used and they are assembled so that they are all positioned in the same horizontal plane with adjacent tubes abutting each other as shown in FIG. 3. The front ends 12 of the tubes 11 are each closed as shown by a forwardly extending closure member 13 of substantially conical shape which is fitted in the open end of the tube. The rear ends 14 of the tubes are each also closed, as shown particularly in FIG. 1 by a similar closure member 15 which is fitted into the open end of the tube so that the conically shaped member extends inwardly of the tube.

Figure 4:
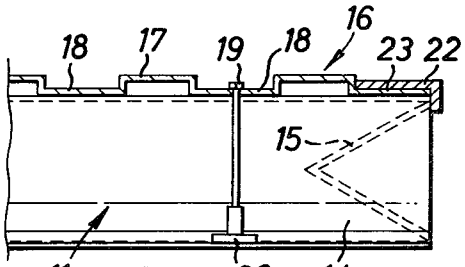
FIG. 4 is a section on the line 4—4 of FIG. 3.

The hull structure in its basic form is completed by a flexible flat deck construction 16 which is mounted over the layer of tubes 11 and which may be of any suitable form. In the drawings the deck is of corrugated or zig-zag construction in section as shown in FIG. 4 so as to provide alternate load receiving strips or platforms 17 and groove sections 18 extending across the hull structure. The corrugated construction of the deck 16 allows for bending of the deck to conform to the configuration applied to the adjacent tubes 11 as will be hereinafter described.

The groove sections 18 of the deck 16 are utilized to provide for the attachment of the deck 16 to the layer of tubes 11. As shown in the embodiment of FIGS. 1 to 4 fixing bolts 19 extend through the deck 16 in selected groove sections 18 and are positioned to pass between adjacent tubes 11. The bolts 19 are connected with T-shaped retaining elements 20 the arms of which abut the adjacent tubes 11 when the bolts 19 are tightened as shown in FIG. 3 to hold the deck 16 tightly against the top surface of the tubes 11. The same groove sections 18 are conveniently used for fixing the tubes 11 in position transversely of the deck structure 16. In the embodiment of FIGS. 1 to 4 side clamping members 21 embrace the outer tubes 11 of the hull structure and are attached at their upper ends to the corresponding groove section 18. Alternatively, each opposite pair of side clamping members 21 may form part of a transverse strip located across the deck structure in the corresponding groove section 18.

As shown in FIG. 2 the completed assembly is a relatively rigid raft-like structure in which the side walls of the tubes 11 are slightly compressed as clearly shown in FIG. 3.

In order to prevent longitudinal movement of the tubes 11 an end beam 22 is provided. The beam 22 is of angular section as shown in FIG. 4 and extends rearwardly over the ends of the tubes 11 after the closure members 15 have been fitted. The beam 22 is rigidly attached across the width of the deck 16 to its end section 23.

The hull structure 10 as now described can be used as a floating raft or pontoon, and a bridge structure can be built by the interconnection lengthways of a number of hulls, the conical closure members 13 at the front ends 12 of the tubes 11 of one hull engaging and fitting within the conical closure members 15 of the rear ends 14 of the tubes 11 of the adjacent hull.

A suitable power unit may be mounted at the rear of the hull to provide a motorized boat and side frames may be added to the deck with a suitable superstructure as desired.

The flexible nature of the hull 10 in the longitudinal direction as provided by the tubes 11 enables the bow of the boat to be provided wth a desired shape by tensioning the tubes so that they are bent upwardly throughout a forward part of their length.

One such embodiment is shown in FIGS. 5 to 8 of the drawings in which the outermost tubes 11A and 11B of the hull structure 10 are provided with suitable lugs 24 for the attachment thereto of cables 25 extending from winches 26 mounted at the sides of the deck 16 at a suitable position along the length of the deck. The front ends of the tubes 11 are interconnected by a link or cable 27 extending between the lugs 24 beneath the front ends of the tubes; alternatively the front ends of the tubes may each be provided with lugs interconnected by links or chains.

Figure 5:
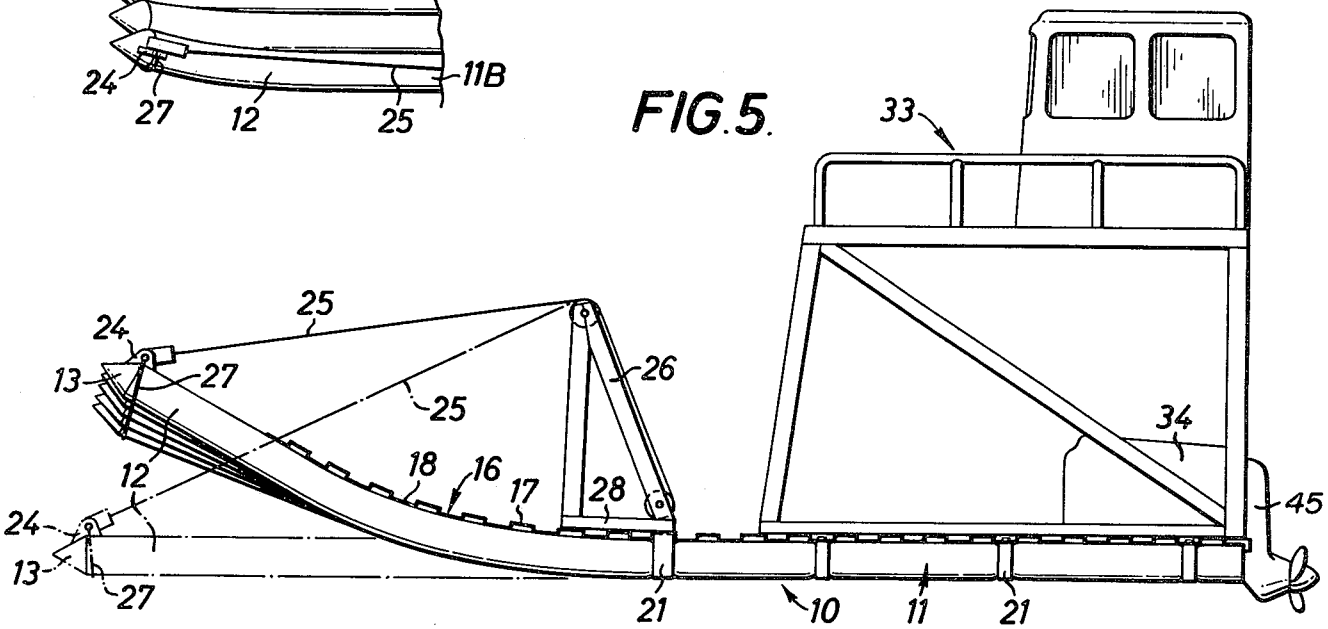
FIG. 5 is a side elevation of a boat incorporating a hull structure in accordance with the invention having lifting means for varying the shape of the bow.
Figure 6:
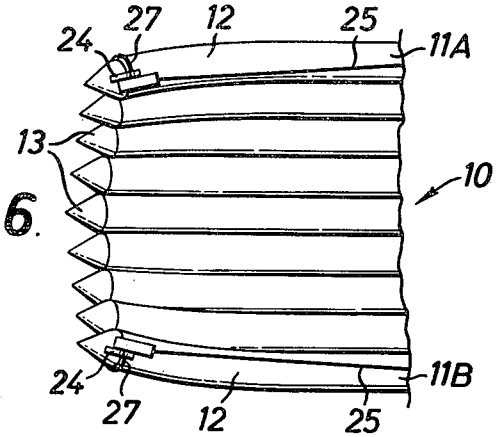
FIG. 6 is a partial plan view of the embodiment of FIG. 5 showing the configuration of the bow when in its lifted position under tension.

The winches 26 are operable to tension the outermost tubes 11 so that a bending moment is applied forwardly of the winches 26 to the front ends of tubes 11A and 11B. Due to the interconnection of the front ends of the tubes 11 by the cable or link 27 the front ends of the intermediate tubes will also be bent upwardly but the general shape imparted to the layer of tubes will follow that of a catenary due to the chain-like interconnection as shown in FIG. 5. The bow will, therefore, assure a prow-like construction as shown in FIG. 6 with the front ends of the outermost tubes bending also inwardly as the tubes are tensioned. To enable the forward part of the deck 16 to follow the upward bending movement of the tubes 11 it may have suitable hinged points, but as shown the deck 16 normally is such as to bend with the tubes. FIG. 5 shows the normal untensioned position of the front portion of the hull forward of the winches 26 in chain lines, and a typical tensioned position in full lines. Obviously the shape of the bow of the boat can be altered as desired to suit requirements and/or prevailing conditions.

Figure 7:
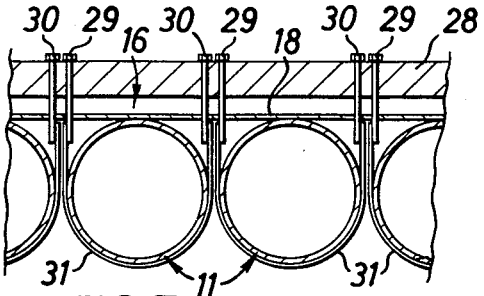
FIG. 7 is a part sectional elevation on an enlarged scale showing one method of fixing the winch to the deck structure.
Figure 8:
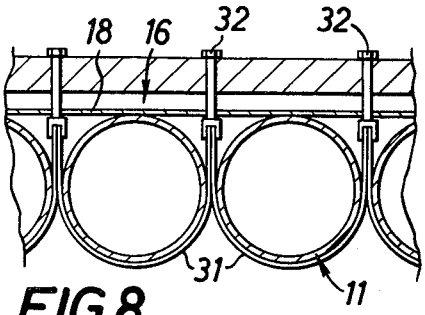
FIG. 8 is a similar part sectional elevation showing an alternative method of fixing the winch to the deck structure.

As shown in FIG. 7 the winches 26 are mounted on a cross-beam 28 which is attached to the deck 16 by pairs of bolts 29, 30, each pair of bolts being connected through the deck structure with the opposite ends of a strap 31 positioned around a corresponding tube 11. An alternative arrangement is shown in FIG. 8 where adjacent bolts 29, 30 are replaced by a single bolt 32 connected to the abutting ends of adjacent straps 31.

The boat is finally completed by a superstructure 33 and an engine 34 driving a propulsion unit 45.

In the embodiment described above the tubes 11 are all of identical length but it will be understood that the length of the tubes may be varied so that the outermost tubes are shortened at the front ends. In other words, the tubes may shorten progressively in length from the innermost tubes to the outermost tubes so that the resulting catenary shape will curve rearwardly towards the outermost members.

Figure 12:
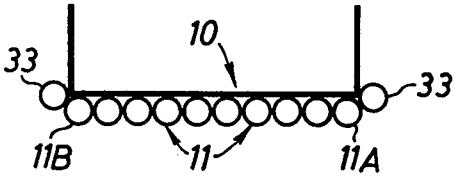
FIG. 12 is a diagrammatic illustration of a hull structure incorporating additional tubes acting as fenders.

The hull construction as described above has considerable advantages in that damaged tubes 11 can be easily replaced or rotated. Spare tubes 33 can be mounted on the hull 10 externally of the tubes retaining members 21 of the deck structure 16 and in this position the spare tubes 33 can act as fenders as shown in FIG. 12.

The tubes 11 are preferably of circular cross section as shown but can be a flattened, somewhat rectangular section.

Figure 13:
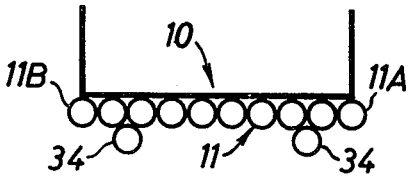
FIG. 13 is a similar diagrammatic illustration showing the positioning of additional tubes beneath the layer of tubes forming the hull structure.

It will, of course, be understood that a hull structure 10 may be formed having more than one layer of tubes 11. For example, tubes 34 could be mounted in a slightly lower horizontal plane while still abutting the layer of tubes 11 mounted immediately beneath the deck structure 16 as shown in FIG. 13.

As described above the hull structure of the invention is primarily intended for a marine craft provided with a power unit. The flexible tube construction is simple to manufacture and is easily maintained. The overall flexible tube construction provides a very advantageous suspension which is substantially indestructible and which permits the craft to operate in extremely shallow water. The structure can be used as a landing craft by beaching the bow portion which can then be lowered to its normal horizontal position by releasing the tension as maintained by the winches 26 on the outermost tubes 11A and 11B. A further feature of the construction is that the bow when provided by the bent up front portions of the tubes forms an integral part of the hull construction.

The hull structure when used as a marine craft is relatively stable during its movement through the water and to a large extent slapping as the hull passes over waves is reduced by the entry of water over the tubes beneath the deck structure. It will be appreciated that the provision of the catenary shape at the front ends of the tubes has the effect of imparting a more gradual curvature to the tubes progressively towards the centre of the hull construction and this shape facilitates the entry and passage of the water during forward movement of the hull. Furthermore, the higher the pressure on the tubes due to the interaction between the rib of the hull and the pressure of the water, the more the tubes will tend to flatten against each other and so provide an adequate seal between each other.

Figure 10:
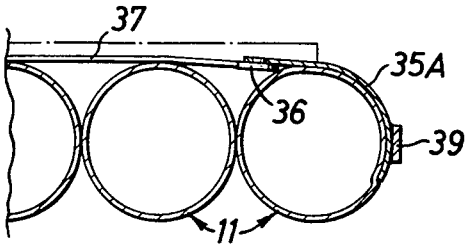
FIG. 10 is a sectional view on the line 10—10 of FIG. 9.
Figure 11:
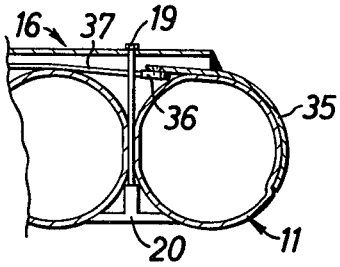
FIG. 11 is a part sectional view showing the fixing of the deck structure to the tubes when utilising the lacing arrangement of FIG. 9.
Figure 9:
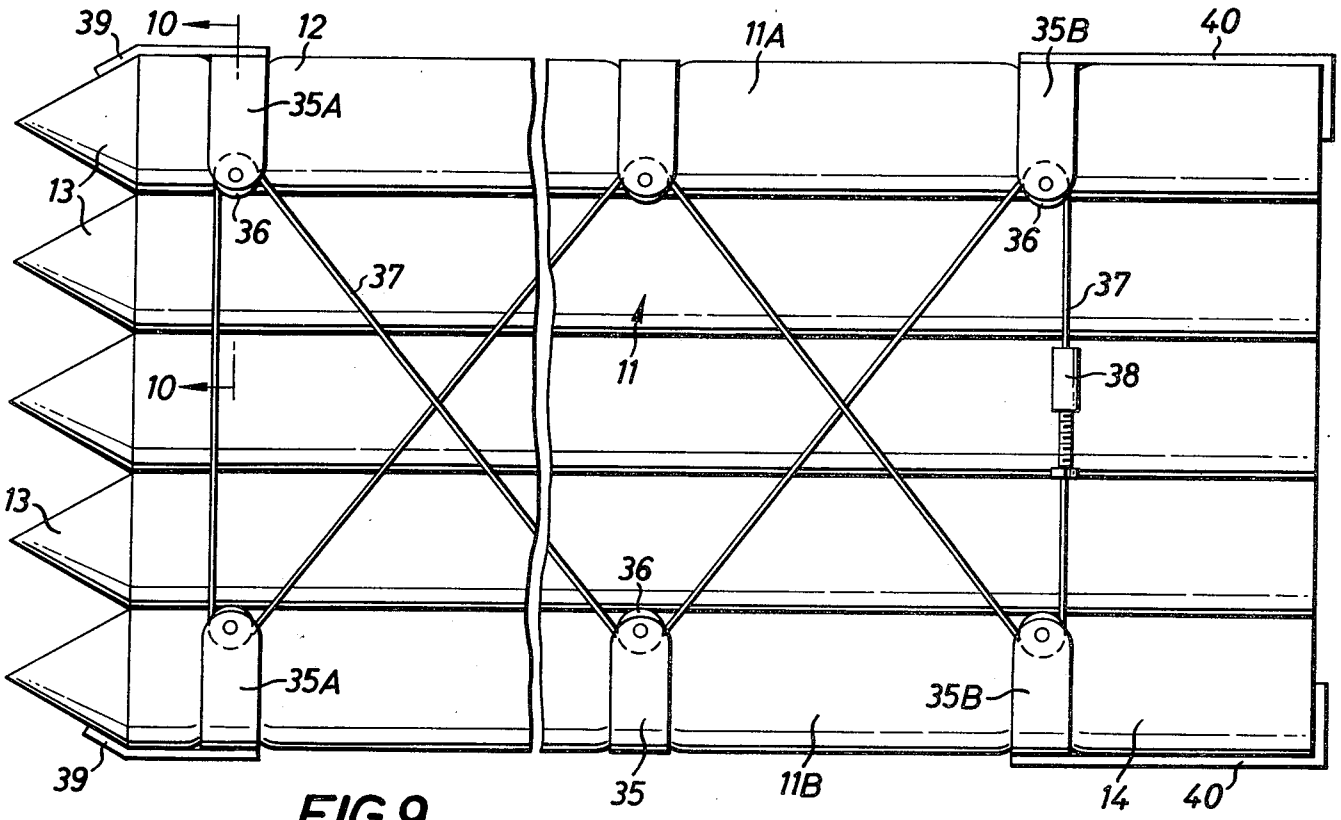
FIG. 9 is a plan view showing an alternative method of clamping the tubes of the hull structure together by means of lacing.

FIGS. 9 to 11 of the drawings illustrate an alternative method of clamping the tubes 11 by lacing. Tube retaining members 35 embrace the sides of the outermost tubes 11A and 11B and are provided above the tubes, allow the deck 16, with pulleys 36 for receiving a cable 37 which is cross-laced as shown in FIG. 9 and tensioned by an adjusting link 38. The front retaining members 35A are provided with integral end clamps 39 engaging over the conical closure member 13 to prevent slipping along the tubes; similarly the rear retaining members 35B are provided with integral clamps 40 engaging the ends of the tubes 11. FIG. 11 is a sectional view showing the fixing of the deck structure 16 to the layer of tubes 11 when braced by the cable 37.

Figure 14:
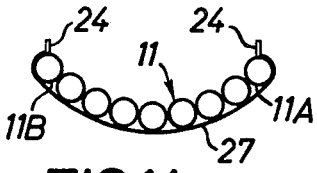
FIG. 14 is a diagrammatic illustration of a bow structure in the form of a catenary obtained by the lifting device.
Figure 15:
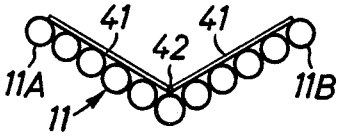
FIG. 15 is a similar diagrammatic illustration of a triangular bow structure obtained by the lifting device.
Figure 16:
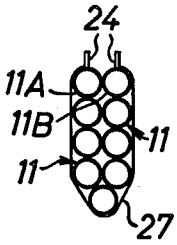
FIG. 16 is another diagrammatic illustration of a further bow shape obtained by the lifting device.

FIGS. 14 to 16 show various bow formations obtained by controlling the linkage of the tubes with the lifting means. FIG. 14 corresponds to the embodiment of FIGS. 5 to 8 and it will be seen that the bow structure follows the shape of a catenary and probably conforms more closely to that of a parabolic catenary. FIG. 15 illustrates a bow structure obtained by providing rigid members 41 hinged at 42 between the tubes 11 so that a triangular section is obtained when the outermost tubes 11A and 11B are tensioned. FIG. 16 illustrates the bow shape which can be obtained by suitable positioning of the winches 26 on the deck 16.

Figure 17:
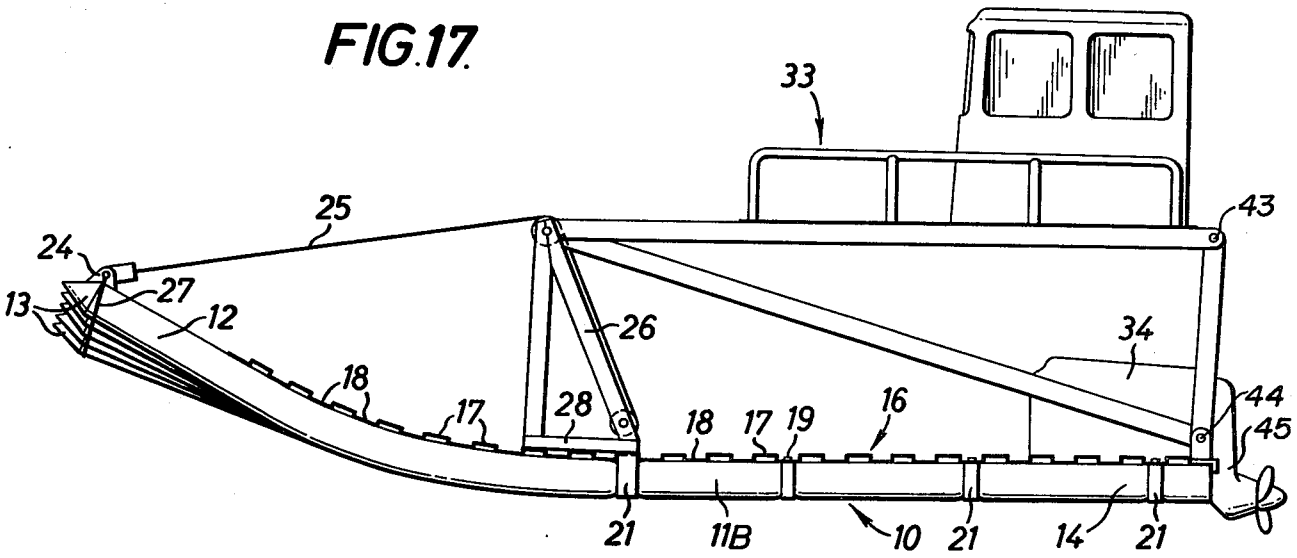
FIG. 17 shows another embodiment of a boat incorporating the hull structure of the invention in which the winches form part of the superstructure.

FIG. 17 shows another embodiment in which the winches form part of the superstructure 33 which is articulated at 43, 44 so that the structure moves with the action of the winches as the tubes are tensioned.

Figure 18:
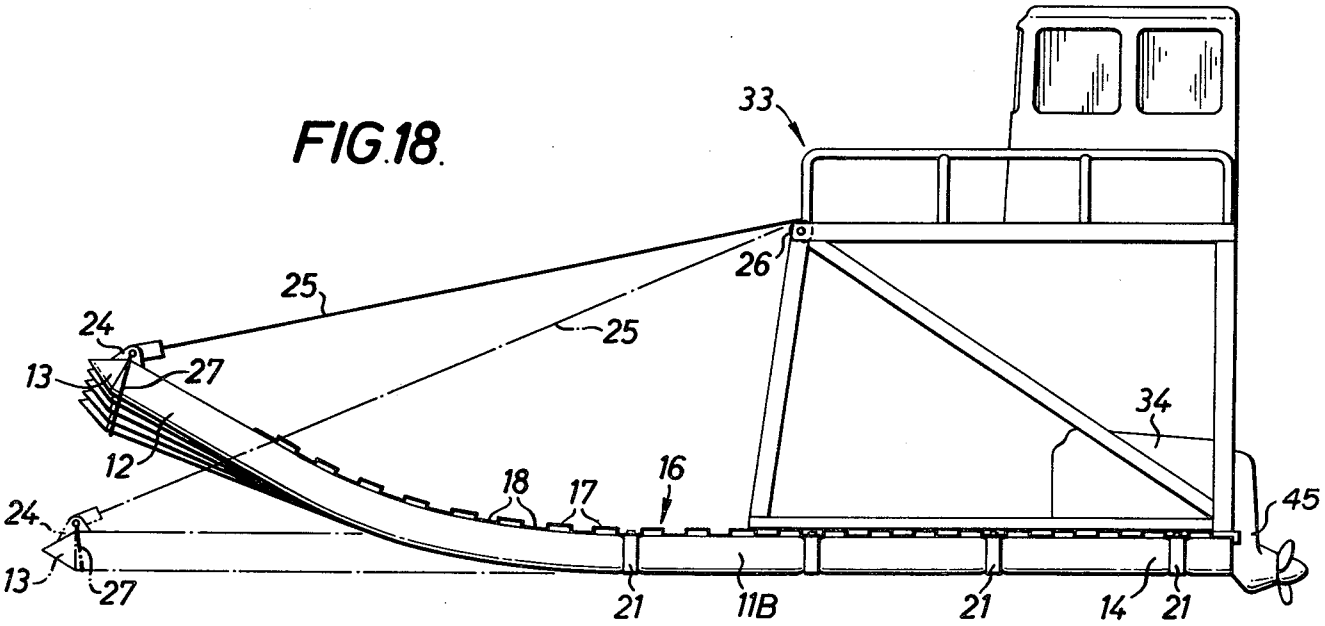
FIG. 18 is another embodiment of a boat incorporating the hull structure of the invention.

FIG. 18 shows another embodiment in which the winch is mounted on a fixed superstructure.

Figure 19:
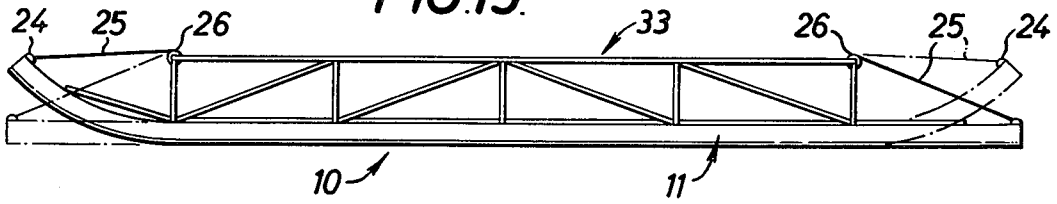
FIG. 19 is a diagrammatic illustration of a hull structure in accordance with the invention fitted with lifting devices at both ends.

FIG. 19 shows a hull structure which is fitted with winches 26 at both ends so as to provide adjustable arrangements for the tubes at both ends of the boat, a structure which is ideal for use as a ferry as the ends can be raised and lowered. In such an arrangement the ends of the tubes may be rigidly interconnected by a flat member so as to provide ramp-like ends to the boat.

I claim:

1. A marine craft driven by power means having a hull structure comprising a plurality of separate, elongated, continuous, self-supporting tubes each made of a substantially rigid, but slightly resilient material and extending longitudinally of the hull structure, said tubes being located side by side in substantially the same horizontal plane and being interconnected with adjacent tubes abutting each other, and means for adjustably tensioning the tubes mounted on said hull structure for raising and lowering one of the longitudinal end portions of the tubes so as to impart a predetermined adjustable upward bending and shaping thereto.

2. A marine craft as claimed in claim 1, having a deck mounted on the tubes, said deck being interconnected with said layer of tubes so as to be fixedly attached thereto.

3. A marine craft as claimed in claim 2, wherein the deck is connected to the layer of tubes by a plurality of connecting bolts each of which is positioned between a pair of adjacent tubes for connection with retaining means engaging said tubes.

4. A marine craft as claimed in claim 3, wherein the retaining means comprises a T member abutting said pair of adjacent tubes.

5. A marine craft as claimed in claim 3, wherein said retaining means comprises a strap located around one of said pair of adjacent tubes.

6. A marine craft as claimed in claim 2, wherein the deck is provided with a plurality of side clamping members for engaging the outer tubes of said layer.

7. A marine craft as claimed in claim 1, wherein the tubes are provided with closure members of conical shape fitting the ends of the tubes, the closure members at one end of said tubes being oppositely directed to enable two or more hull structures to be interfitted to form a bridge or pontoon assembly.

8. A marine craft as claimed in claim 1, wherein said tensioning means comprises winches located at the sides of said structure at a position intermediate its length, said winches being connected to said one longitudinal end portion of the outermost tubes for imparting a predetermined adjustable upward bending movement thereto.

9. A marine craft as claimed in claim 8, wherein the one longitudinal end portion of said tubes are interconnected so that said tensioning means imparts a predetermined shape to that end of said tubes which is in the form of a catenary.

10. A marine craft as claimed in claim 1, having additional means for tensioning the tubes thereon for imparting a predetermined adjustable upward bending or shaping of the other longitudinal end portion of the tubes of said hull structure whereby both ends of the hull structure can be raised.

11. A marine craft as claimed in claim 1, wherein the tubes are made from polyethylene, polypropylene or acrylonitrile-butadiene-styene resins.

12. A marine craft as claimed in claim 1, wherein the tubes are interconnected by retaining members engaging the sides of the outermost tubes, said retaining members being interconnected by adjustable lacing.

13. A marine craft as claimed in claim 1, further comprising a superstructure and power means such as an engine driving a propulsion unit.

14. A marine craft as claimed in claim 1 wherein:

said tensioning means are adjustable to vary the tension on the tubes so that the one longitudinal end portion thereof can be raised and lowered to different elevations relative to the horizontal plane down to a lower elevation in which said one longitudinal end portion substantially lies in said horizontal plane.

* * * * *